US007617556B2

(12) United States Patent
Rensink

(10) Patent No.: US 7,617,556 B2
(45) Date of Patent: Nov. 17, 2009

(54) MATTRESS SYSTEMS AND METHODS OF MAKING

(75) Inventor: Robert L Rensink, Denver, CO (US)

(73) Assignee: Denver Mattress Co., LLC, Lakewood, CO (US)

( * ) Notice: Subject to any disclaimer, the term of this patent is extended or adjusted under 35 U.S.C. 154(b) by 202 days.

(21) Appl. No.: 11/231,029

(22) Filed: Sep. 19, 2005

(65) Prior Publication Data

US 2006/0059631 A1 Mar. 23, 2006

Related U.S. Application Data

(60) Provisional application No. 60/610,717, filed on Sep. 17, 2004.

(51) Int. Cl.
*A47C 31/00* (2006.01)

(52) U.S. Cl. ..... 5/739; 5/691

(58) Field of Classification Search ..... 5/691, 5/716, 739, 655.7, 201, 203, 207, 238, 305
See application file for complete search history.

(56) References Cited

U.S. PATENT DOCUMENTS

| | | | | |
|---|---|---|---|---|
| 685,160 | A | 10/1901 | Marshall | |
| 757,414 | A * | 4/1904 | Rodgers | 428/76 |
| 2,862,214 | A | 12/1958 | Thompson et al. | |
| 3,869,739 | A | 3/1975 | Klein | |
| 4,234,983 | A | 11/1980 | Stumpf | |
| 4,463,466 | A | 8/1984 | May et al. | |
| 4,578,834 | A | 4/1986 | Stumpf | |
| 4,854,023 | A | 8/1989 | Stumpf | |
| 5,040,255 | A | 8/1991 | Barber, Jr. | |
| 5,317,768 | A | 6/1994 | Klancnik | |
| 5,469,590 | A | 11/1995 | Simon | |
| 5,475,881 | A * | 12/1995 | Higgins et al. | 5/737 |
| 6,023,803 | A | 2/2000 | Barman | |
| 6,029,957 | A | 2/2000 | Zysman | |
| 6,088,858 | A * | 7/2000 | Juster et al. | 5/737 |
| 6,243,900 | B1 | 6/2001 | Gladney et al. | |
| 6,292,965 | B1 | 9/2001 | Gambrell | |
| 6,295,676 | B1 | 10/2001 | Warner | |
| 6,338,174 | B1 | 1/2002 | Stjerna | |
| 6,408,469 | B2 | 6/2002 | Gladney et al. | |
| 6,571,413 | B1 | 6/2003 | Stjerna | |
| 6,643,876 | B2 | 11/2003 | Visser et al. | |
| 6,658,682 | B1 * | 12/2003 | Wells | 5/655.7 |
| 6,701,557 | B2 | 3/2004 | Barman | |
| 2002/0184712 | A1 | 12/2002 | Gladney et al. | |

* cited by examiner

*Primary Examiner*—Fredrick Conley
(74) *Attorney, Agent, or Firm*—Townsend and Townsend and Crew LLP

(57) ABSTRACT

Mattress systems and methods for their construction are provided. One such mattress includes a first mattress core and a second mattress core positioned on top of the first mattress core. A border material extends along an outer first edge of the first mattress core and along an outer second edge of the second mattress core. The border material has an intermediate portion which extends between the first and second mattress cores and is coupled to at least one of the first and second mattress cores, and in some aspects to both cores.

18 Claims, 6 Drawing Sheets

MATTRESS SYSTEMS AND METHODS OF MAKING

CROSS-REFERENCE TO RELATED APPLICATIONS

This application claims the benefit of U.S. Provisional Application No. 60/610,717, filed Sep. 17, 2004, entitled "Mattress Systems And Methods Of Making," the complete disclosure of which is herein incorporated by reference.

The present application is related to U.S. patent application Ser. No. 10/705,640, entitled "No-Flip Mattress Systems And Methods," filed Nov. 10, 2003, and U.S. patent application Ser. No. 10/704,879, entitled "High Comfort Mattresses And Methods For Constructing Them," filed Nov. 10, 2003, each of which are assigned to the assignee of the present invention and the complete disclosures of which are incorporated herein by reference for all purposes. Additional details on mattress cores used for some embodiments of the present invention may be found in U.S. Pat. No. 6,643,876, entitled "No-Flip Mattress And Methods For Their Construction," filed Nov. 21, 2001, also assigned to the assignee of the present invention and the complete disclosure of which is incorporated herein by reference for all purposes.

BACKGROUND OF THE INVENTION

This invention relates generally to the field of mattresses, and in particular to mattresses having improved support, comfort and ease of manufacture.

Spring mattresses have been in use for over 100 years. Existing spring mattresses use a variety of spring types to form their inner core. Perhaps the most common is the traditional wire spring assembly having a set of interconnected wire spring coils. As is well known in the art, a major supplier of such springs is Leggett & Platt.

Another type of spring assembly is the so-called Marshall construction that was developed in the late 1890's by Marshall Mattress of Toronto, Canada. The Marshall design utilizes fabric pockets to encapsulate each spring. In this way, the coils may flex separately from each other. Examples of such pocket coil spring designs are described in, for example, U.S. Pat. Nos. 685,160, 4,234,983, 4,854,023, 6,029,957, and 6,295,676 and International Publication No. WO99/32396, among others. The complete disclosures of all these references are herein incorporated by reference.

Traditional mattresses have a padding layer disposed both on top of and beneath the core of springs. This is encased within a fabric or ticking, and may optionally include additional layers of padding to form a "pillow top" mattress as is known in the art. Because of potential uneven wear during the life of the mattress, many manufacturers recommend periodically rotating or flipping the mattress. However, because this can be difficult and inconvenient, many users do not follow this practice. For those that do, this exercise can be annoying.

As a result, the one-sided or no-flip mattress has been developed. Several manufacturers have developed and sold such mattresses at least as early as the mid 1990s. For instance, Sleep Therapy mattresses have been sold by Wickline Bedding Co., San Diego, Calif. since the early 1990s. These mattresses have a polyurethane foam layer underneath the springs and a traditional padding layer on top. This design was subsequently adopted by Simmons Company as demonstrated by their U.S. Pat. No. 6,243,900, the complete disclosure of which is herein incorporated by reference.

The present invention is related to improved mattresses and methods for manufacturing so called one-sided or no-flip mattresses, although in some embodiments the invention includes two-sided or flip mattresses. Further, such mattresses may be economically produced to provide a commercially attractive mattress.

BRIEF SUMMARY OF THE INVENTION

The invention provides exemplary mattresses as well as methods for their construction. In some embodiments the mattresses are one-sided or no-flip mattresses, and in other embodiments they include two-sided or flip mattresses. As described hereinafter, such mattresses provide increased firmness, stability and comfort, among other features. In one embodiment, a mattress comprises a first mattress core and a second mattress core positioned on top of the first mattress core. A border material extends along an outer first edge of the first mattress core and along an outer second edge of the second mattress core. The border material has an intermediate portion which extends between the first and second mattress cores and is coupled to at least one of the first and second mattress cores, and in some aspects to both cores.

In one aspect, the border material is a single piece of material spanning at least from the first outer edge to the second outer edge and including the intermediate portion. In this manner, the border is not comprised of multiple pieces of material which need to be taped and subsequently sewn together. Instead, in some aspects the single piece of material presents a more flush appearance of the two cores.

In some embodiments, the first and second mattress cores each have a plurality of coils therein, and in a particular embodiment, the coils in the second mattress core extend about to an edge of the second mattress core. In this manner, the sleeping surface is supported to near the edge of the second mattress core, resulting in a greater effective area on which to sleep or rest. In some aspects, the outermost coil disposed in the second mattress core is positioned generally over an outermost coil disposed in the first mattress core. This arrangement further facilitates a well-supported sleeping surface.

In one aspect, the outer edges of the first and second cores are generally flush. The cores themselves may comprise a wide range of materials, including without limitation latex, foam, fiber and/or springs. Further, the border material may wrap around the lower edge of the first mattress core. Such an arrangement again reduces the number of pieces otherwise necessary to provide a mattress side wall or border.

While some embodiments of the present invention are directed to no-flip mattresses, other embodiments are not so limited. For example, one embodiment includes a third mattress core positioned under the first mattress core. The border material may extend along an outer third edge of the third mattress core. In this case, the border material includes a second intermediate portion which extends between, and is coupled to at least one of the first and third mattress cores.

In another embodiment, a mattress includes a first mattress core and a second mattress core positioned on top of the first mattress core. A border couples the first mattress core to the second mattress core, with an intermediate portion of the border extending between, and being coupled to at least one of the two mattress cores. The first and second mattress cores each include a plurality of coils. The coils in the second mattress core extend about to an edge of the second mattress core.

The present invention also provides exemplary methods of manufacturing mattresses, including but not limited to mattresses of the present invention. In one such method, a first mattress core is provided having a first outer edge, and a second mattress core having a second outer edge is placed over the first core mattress. A border material is attached to the first outer edge and the second outer edge. The border material has an intermediate portion disposed between and coupled to at least one of the first and second mattress cores.

In one embodiment, the border material includes a continuous piece of material extending at least from the first outer edge to the second outer edge and including the intermediate portion. In this manner, ease of manufacture is accomplished. In one aspect, first and second false seams are created in the border material, one on each side of the intermediate portion.

In one aspect, attaching the border material intermediate portion between the first and second mattress cores biases the first outer edge towards the second outer edge. This biasing may reduce the size of an air gap between the first and second mattress cores. The increased flatness at the mattress core edges provides improved performance in a flammability test used for testing the flame retardancy of mattresses.

In one aspect, the border material intermediate portion is attached between the first and second mattress cores by stitching using a thread that is substantially free of Kevlar. While Kevlar threads may be used in the exterior of the mattress, the attached intermediate portion is, in one embodiment, sufficiently disposed between the two mattress cores to obviate the need for flame retardant stitching.

In some aspects, the mattress cores are positioned such that an outermost coil disposed in the second mattress core is generally over an outermost coil disposed in the first mattress core. In other aspects, the outermost coils in the first and second mattress cores are adjacent the first and second outer edges, respectively. In this manner, the mattress is manufactured with abundant sleeping surface area.

Other objects, features and advantages of the present invention will become more fully apparent from the following detailed description, the appended claims and the accompanying drawings.

DETAILED DESCRIPTION OF THE INVENTION

Figure 1:
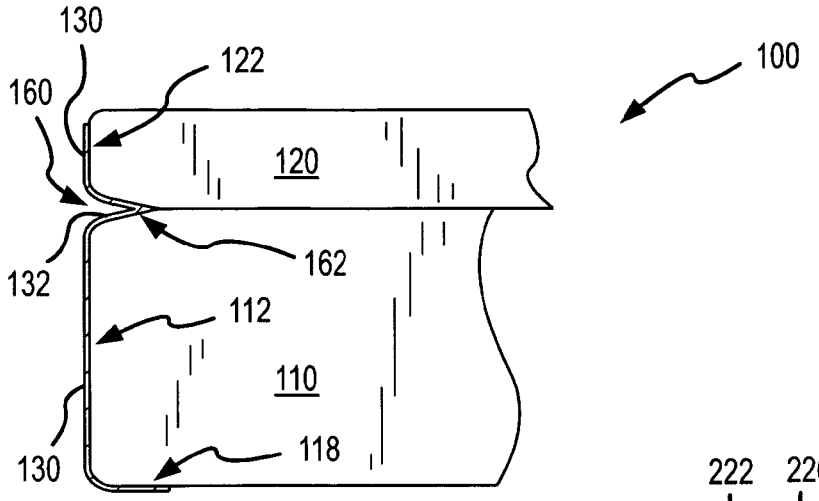
FIG. 1 is a simplified side view of a portion of a mattress according to an embodiment of the present invention.

FIG. 1 depicts a simplified side view of a mattress 100 according to one embodiment of the present invention. Mattress 100 includes a first mattress core 110 having a first outer edge 112, and a second mattress core 120 having a second outer edge 122. Mattress cores 110, 120 each may be comprised of a variety of material(s), including latex, rubber, foam, fiber, interconnected springs, visco-elastic materials, air or water bladders, horse hair, goose down, springs surrounded by foam, and the like. Mattress 100 includes a border 130 that extends along outer edges 112 and 122. Border 130 may comprise a number of different materials, including various fabrics and the like. Border 130 has an intermediate portion 132 that extends at least part way between mattress cores 110 and 120. In one embodiment, intermediate portion 132 is coupled to at least one opposing surface of mattress cores 110 and 120 at an attach point 162. Attach point 162 may be created using stitching or the like. In a particular embodiment, attach point 162 comprises stitching made of thread that is substantially free of Kevlar. Kevlar thread is commonly used due to its fire retardant characteristics. In one embodiment, attach point 162 is sufficiently disposed between mattress cores 110 and 120 so that Kevlar thread is not needed. In this manner, a less expensive thread may be used.

In one embodiment, the attachment of border 130 to mattress cores 110 and 120 draws or biases outer surfaces 112 and 122 towards each other. In this manner, an air gap 160 that typically occurs between opposing corners of edges 112 and 122 is reduced. By reducing the gap between the corners of edges 112 and 122, the mattress has improved performance during industry standard fire tests. As shown in FIG. 1, in one embodiment border 130 includes as extension 118 that extends around and under the lower edge of mattress core 110.

Typically, mattress cores are coupled together using complex taping and stitching methods. For example, the border may be made up of several separate pieces of border material, which are first taped together and then sewn together at the taped locations. For example, the border material may be cut to match the outer edges of the mattress cores and coupled together at multiple locations between the cores. Further, the border may be further coupled to a gusset or flange disposed between two mattresses, providing still another location at which multiple border pieces need be attached. In one embodiment of the present invention, border 130 is a single piece border material extending along outer edge 122, through intermediate portion 132, and along outer edge 112. In this manner, a more simplified manufacturing process is available due in part to the elimination of one or more taping and/or stitching steps.

In one embodiment, mattress 100 is constructed such that the top surface formed by core 120 or additional layers disposed thereover is the only sleeping surface. In this way, mattress 100 does not need to be periodically flipped to the other side. Further, in one embodiment a dense bottom support layer (not shown) is used to provide mattress 100 with a durable construction to provide increased life. One particularly effective material for the bottom support layer is a matrix of foam pieces, known as rebond. This material is firm and is constructed of a variety of small urethane or other foam pieces (typically reclaimed) that are joined together using an adhesive, heat and steam that tend to increase the density. Such a material is relatively dense, has an IFD in the range from about 40 to about 80 and is relatively inexpensive. Other types of materials that may be used include polystyrene materials, polyurethane, densified fibers and the like. This bottom support layer may be coupled to core 110 using a variety of techniques, including, the use of hog rings, glue, stitching, staples and the like.

Figure 2:
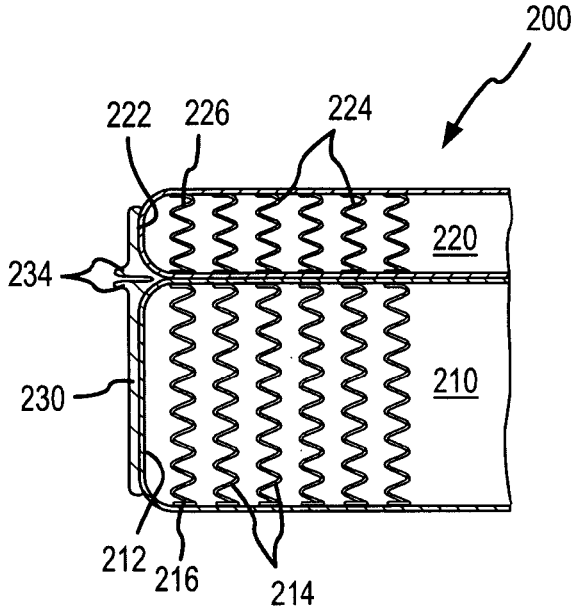
FIG. 2 is a simplified cross-sectional side view of a mattress embodiment of the present invention.

FIG. 2 depicts an alternative embodiment of the present invention. In this embodiment, the mattress 200 includes first and second mattress cores 210, 220. In this embodiment, at least one, and sometimes both mattress cores include a plurality of springs. More specifically, a plurality of springs 214 is disposed within mattress core 210, and a plurality of springs 224 is disposed within mattress core 220. In one particular embodiment, springs 214 are encased in fabric. Springs 214 may be individually encased in fabric, or groups of springs may be encased. Although useful with any core of springs that are encased in fabric, the mattresses of some embodiments of the invention will achieve particular advantages when constructed of pocket coil springs that are able to move independently from one another. For example, the mattresses may be constructed of pocket coil springs that are formed as strings, with the strings being coupled to each other near midpoints of adjacent springs, although other techniques may be used as well. Examples of such spring assemblies are described in International Publication No. WO99/32963 and U.S. Pat. Nos. 6,029,957 and 4,578,834, among others. These disclosures are herein incorporated by reference.

In another embodiment, springs 224 in second mattress core 220 are relatively small coils. In a particular embodiment, springs 224 are similar to or the same as those described in U.S. Pat. No. 6,571,413, entitled "Spring Mattress," or U.S. Pat. No. 6,338,174, entitled "Spring Mattress," the complete disclosures of which are incorporated herein by reference. In a particular embodiment, an outermost spring 226 in mattress core 220 is disposed generally over an outermost spring 216 in mattress core 210. Further, as shown in the embodiment of FIG. 2, the alignment of springs 226 and 216 is generally adjacent mattress edges 222 and 212, respectively. This configuration provides sufficient support near the edge of mattress 200. As a result, a greater sleeping surface area is provided.

As shown in the embodiment of FIG. 2, a border 230 is coupled to cores 210 and 220 along edges 212 and 222. Border 230 may be similar to border 130 described in conjunction with FIG. 1, and may comprise the same or similar materials. In this embodiment, one or more false seams 234 are provided within border 230. False seams 234 may be formed, for example, by folding over the border material and attaching the material to itself to create the impression a seam exists. Prior art fabrications of the border would couple two separate border material pieces at these locations. However, in one embodiment of the present invention, border 230 is made from a single piece of material, which is doubled or otherwise folded over at the false seam locations to create the impression that a seam exists. In this manner, border material 230 looks aesthetically the same as or similar to prior border materials, however with the added benefits in ease of manufacture due to elimination of one or more taping steps. Further, while border 230 depicted in FIG. 2 does not extend around a lower edge of first mattress core 210, in other embodiments it may.

Figure 3:
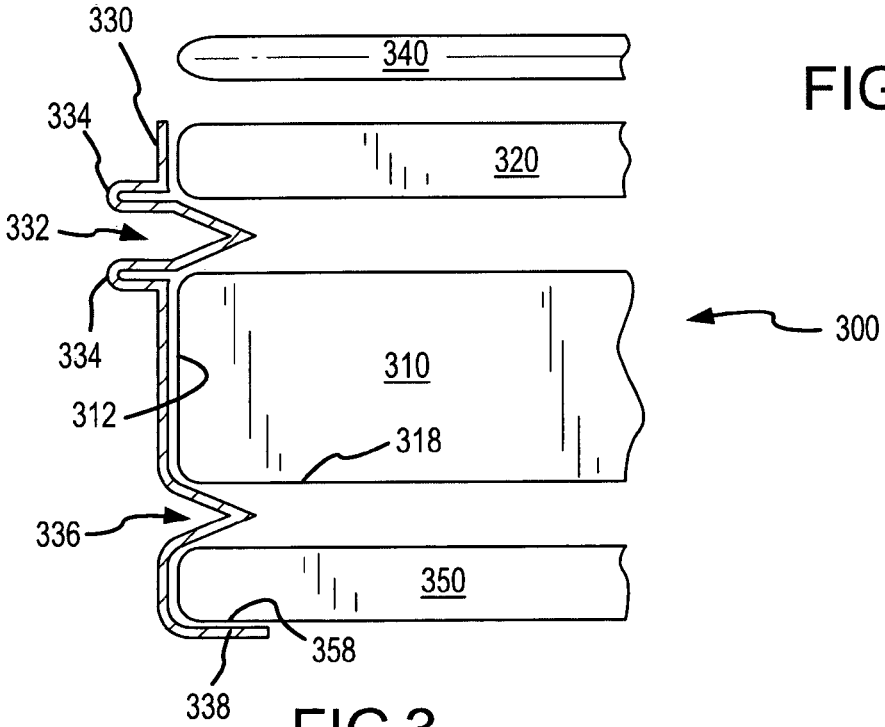
FIG. 3 is a simplified exploded side view of a mattress according to an embodiment of the present invention.

Turning now to FIG. 3, still another embodiment of the present invention will be described. FIG. 3 depicts a simplified exploded view of a flip or two-sided mattress 300. In this embodiment, mattress 300 includes a first mattress core 310 that is similar to or the same as core 110 or 210. Mattress 300 includes a second mattress core 320 that is similar to or the same as mattress core 120 or 220. Mattress 300 includes a third mattress core 350 disposed on an opposite side of mattress core 310 as is mattress core 320. Further, mattress 300 may include one or more additional layer(s) disposed between mattress cores 310 and 320, between mattress cores 310 and 350, over core 320 and/or under core 350. It will be appreciated by those skilled in the art that the terms over and under are used to describe the particular mattress 300 orientation shown in FIG. 3, but are not intended to be limiting of the present invention.

A wide variety of optional layers may be included with mattress 300. In one embodiment, a layer 340 is disposed over mattress core 340. Layer 340 may comprise padding, ticking, foam, a quilted layer, or the like. In one embodiment, layer 340 is a top padding layer 340 which may be constructed of a material such as a polyurethane or latex foam, a visco-elastic or memory foam material, or the like. Top padding layer 340 may simply rest on core 320 to permit independent movement of springs therein. In another embodiment, layer 340 is one or more foam layers similar to the foam layers described in copending U.S. patent application Ser. No. 10/704,879, entitled "High Comfort Mattress And Methods For Constructing Them," previously incorporated herein by reference. These padding layers may be incorporated into a quilting to form a pillow top mattress, or may not be incorporated directly into the quilting to form a plush top mattress.

In the embodiment of FIG. 3, mattress 300 includes a border 330 having first and second intermediate portions 332 and 336. Intermediate portion 332 is adapted to be coupled to and between mattress cores 310 and 320. In one embodiment, intermediate portion 332 is coupled to one of the two mattress cores 310 and 320. In another embodiment, intermediate portion 332 is coupled to both mattress cores 310 and 320. Similarly, in one embodiment second intermediate portion 336 is coupled to one or both of mattress cores 310 and 350. At least a part of intermediate portion 332 extends between cores 310 and 350 as needed to coupled portion 332 thereto. In one embodiment as shown in FIG. 3, border 330 includes one or more false seams 334, which may be similar to false seams 234 described in conjunction with FIG. 2. In one embodiment, false seams 334 are disposed near the interface of mattress cores 310 and 320, but not near the interface of mattress cores 310 and 350. In an alternative embodiment, the interface of mattress cores 310 and 350 also may have false seams. In the depicted embodiment, border 330 includes an extension 338 that extends at least partway around the outer surface of mattress core 350. In another embodiment, extension 338 extends the full width of mattress core 350 to provide an additional layer. In one embodiment, border material 330 includes a similar extension that extends around part or the entire upper surface of mattress core 340. These extensions may form a separate layer for mattress 300, or may comprise some or all of layer 340.

In one embodiment, mattress 300 is a flip or two-sided mattress. In this manner, mattress core 350 may be a sleeping surface, or mattress core 320 may be a sleeping surface, depending on the orientation of mattress 300 relative to the user. In a particular embodiment, mattress 300 is a pillow top mattress in which layer 340 comprises foam, quilting, or other material to define the "pillow top". In one embodiment, users who only desire the pillow top feature a portion of the time can flip the mattress over to use mattress core 350 as the sleeping surface.

In some embodiments, mattress cores 310, 320 and/or 350 each have a plurality of springs disposed therein. In some embodiments, the outermost springs in one or more of the mattress cores are disposed near an outer edge of the mattress core. In a particular embodiment, the outermost spring in core 320 is disposed generally over or in alignment with an outermost spring in core 310. Similarly, an outermost spring in core 350 may be generally under or in alignment with the outermost spring in core 310. In this manner, the edges of cores 320 and 350 have sufficient support, and in some cases provide for an increased sleeping surface.

It will be appreciated by those skilled in the art that mattresses of the present invention may include additional layers, including those described in the applications and patents previously incorporated herein by reference. Optional backing materials may be placed next to the mattress cores for protection thereof. One or more intermediate padding layers (not shown) may be positioned between mattress cores or various other layers. The intermediary layers may be used to provide the mattress with additional comfort. These layers may be used alone or in various combinations. For example, one intermediary layer may comprise a foam material, such as a polyurethane foam. Polyurethane foams with desirable characteristics are manufactured under the trade name Quiltflex from FoamEx, Inc. Another intermediary layer may comprise a piece of latex rubber or a visco elastic material. One or both sides of this layer could also be convoluted or have a contoured surface, and may have a thickness in the range from about 0.5 inches to about 3 inches. Other materials that may be used as an intermediate layer include fiber padding materials. Mattresses of the present invention may include a layer of ticking that is a piece of fabric or quilting that envelopes the mattress as is known in the art. The ticking may comprise essentially any type of fabric or covering and may be sewn to form it around the core and other padding layers. In a particular embodiment, borders of the present invention comprise some or all of the ticking layer.

Figure 4:
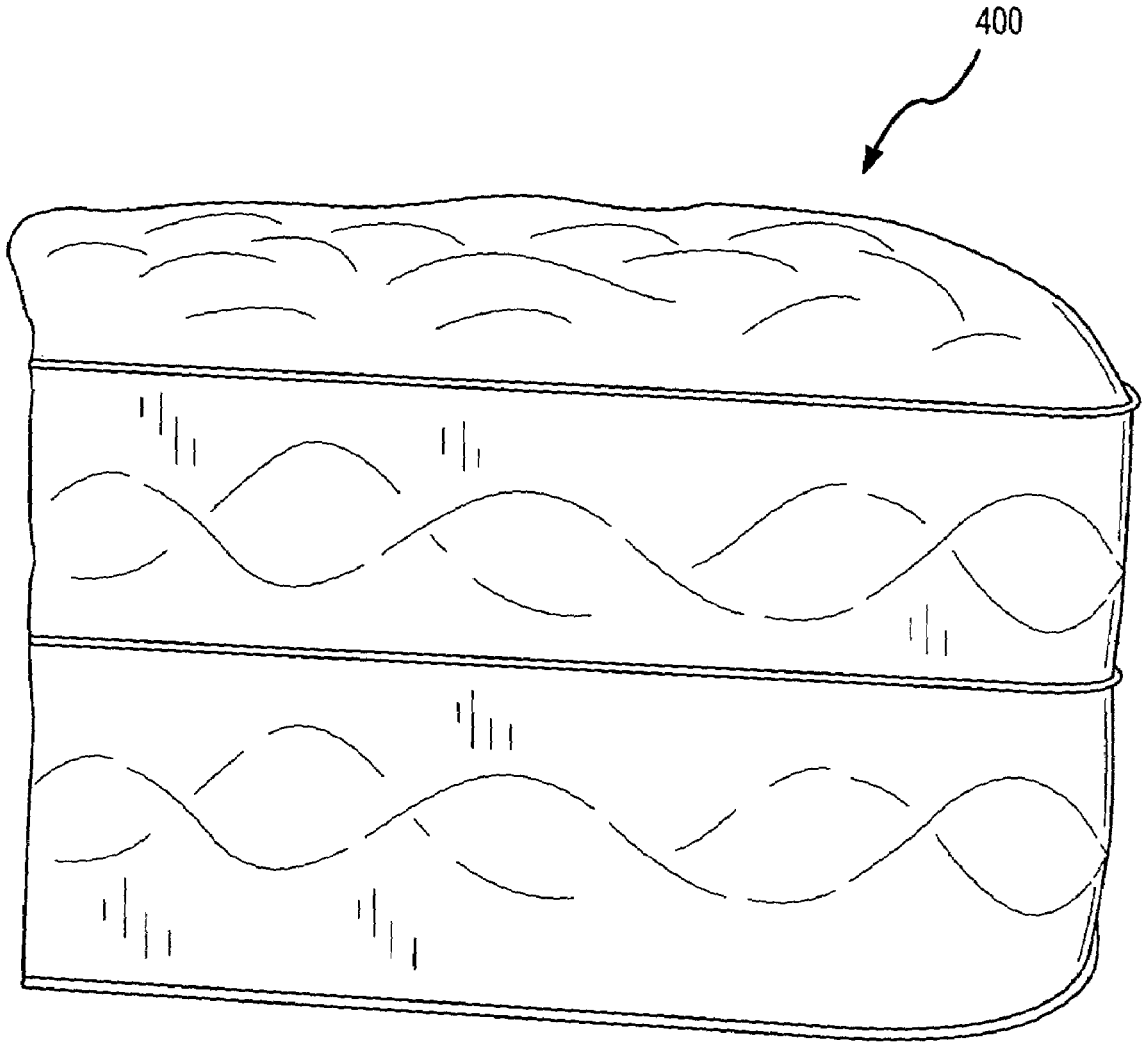
FIG. 4 is a view of a portion of a mattress according to an embodiment of the present invention.
Figure 5A:
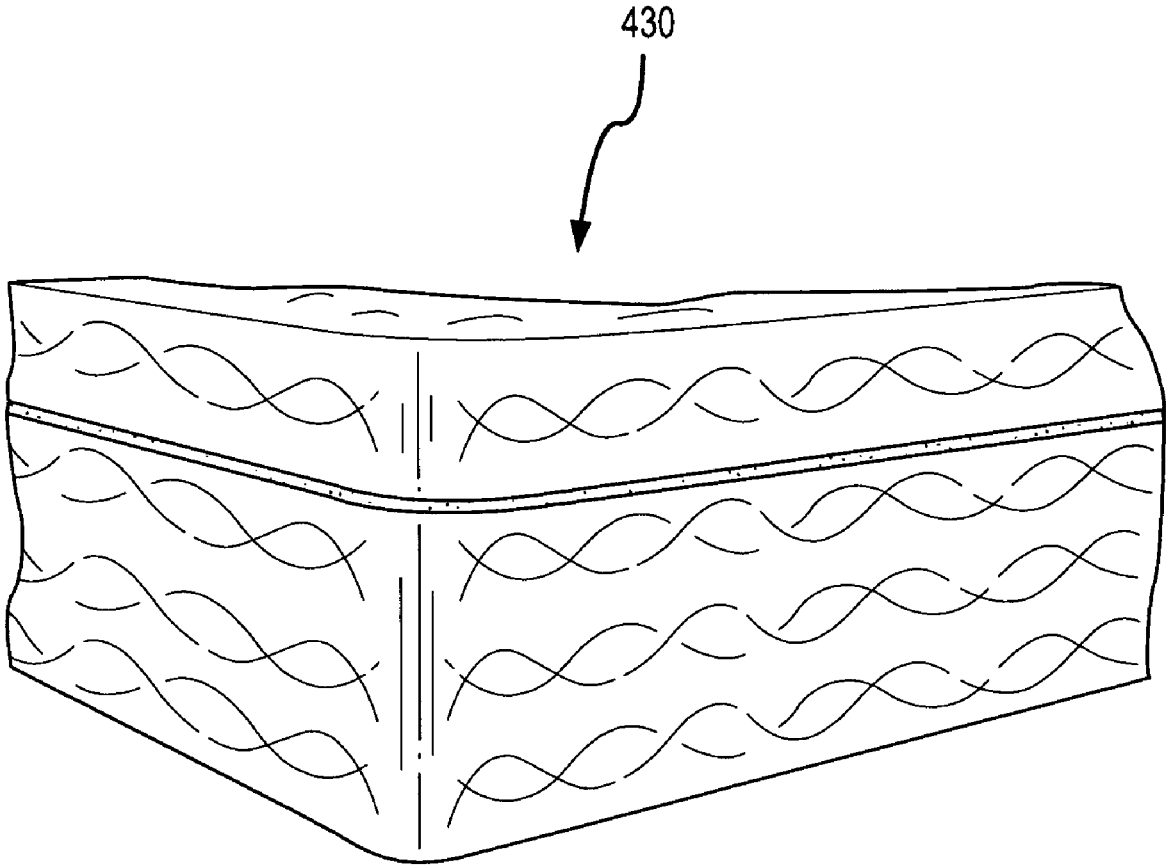
FIGS. 5A and 5B are perspective views of a mattress border for coupling to corner sections of two mattress cores according to an embodiment of the present invention.
Figure 5B:
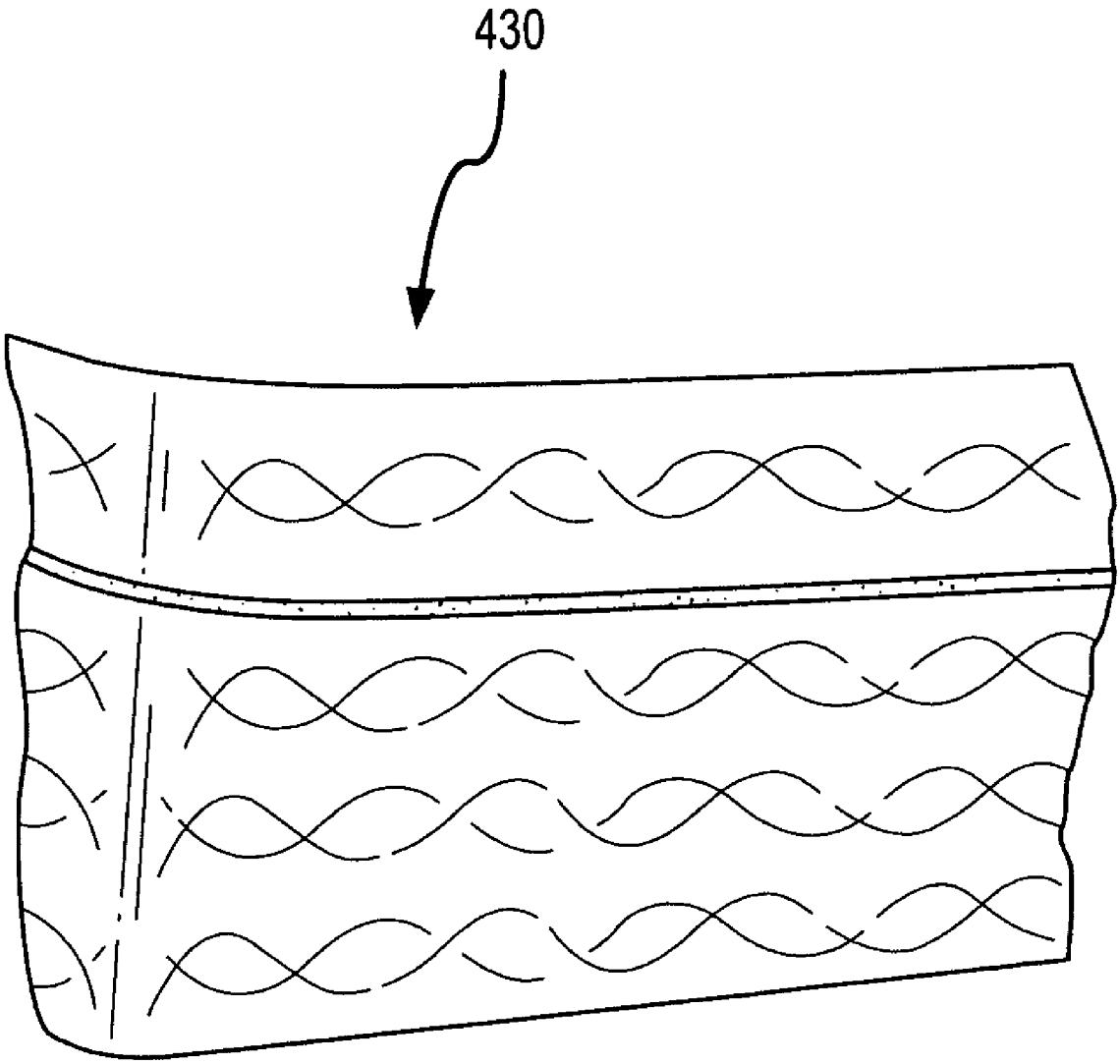
Figure 6A:
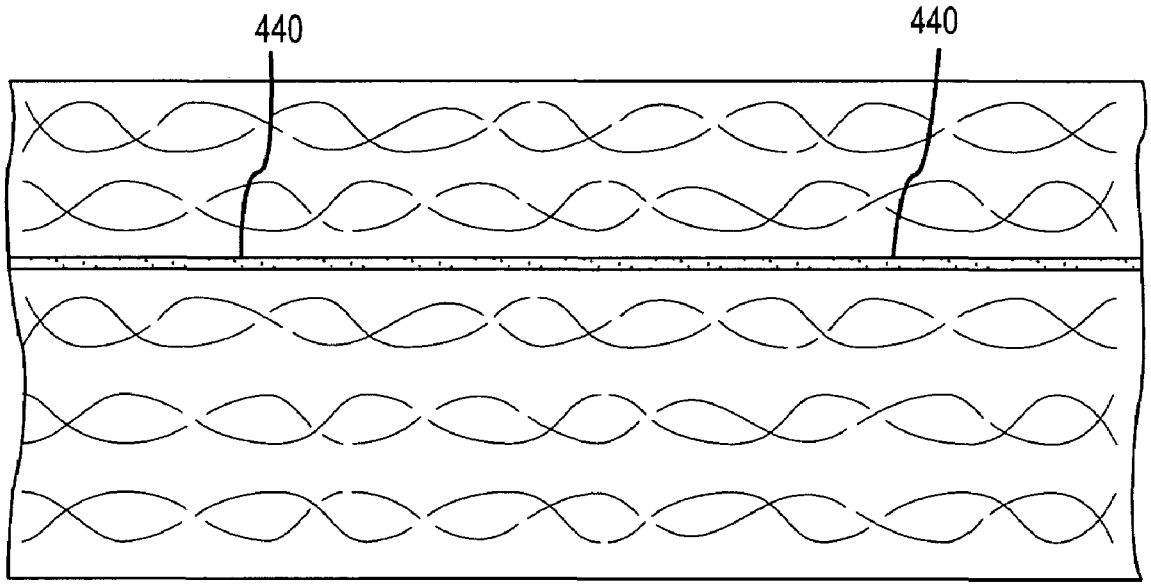
FIG. 6A is a front view of a mattress border showing a false seam according to an embodiment of the present invention.
Figure 6B:
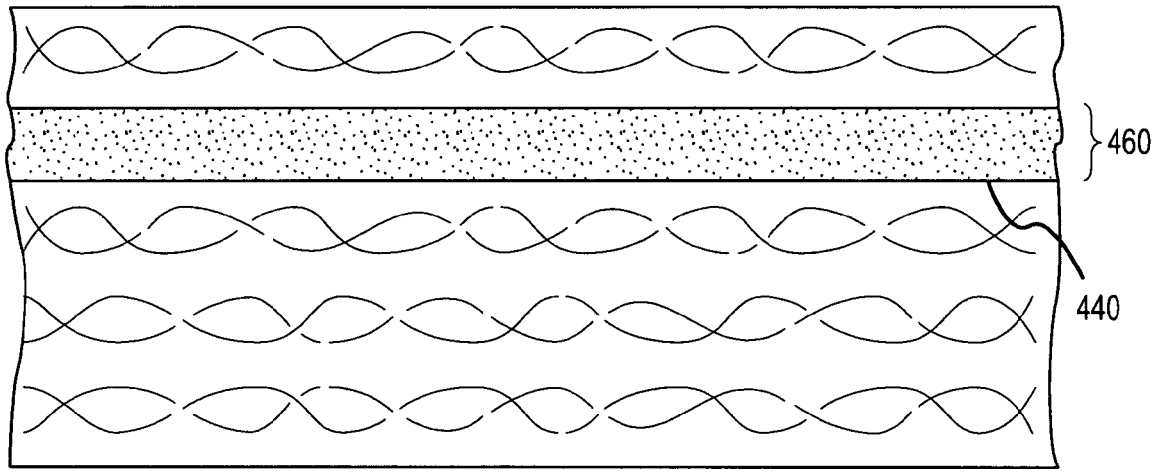
FIG. 6B is a view of the opposite surface of the border of FIG. 6A, depicting an extended intermediate portion according to an embodiment of the present invention.

FIGS. 4-6B depict various aspects of a mattress 400 according to an embodiment of the present invention. For example, FIG. 4 depicts a portion of mattress 400 having two mattress cores and a border attached thereto, and FIGS. 5A and 5B depict a mattress border 430 for coupling to corner sections of the two mattress cores. In FIGS. 6A and 6B, a mattress border is depicted with a false seam 440 shown (FIG. 6A), and an extending intermediate section 460 (FIG. 6B) on the opposite side of the border.

The invention has now been described in detail for purposes of clarity and understanding. It will be appreciated, however, that while certain features are described in conjunction with select embodiments, mattresses of the present invention are not so limited. For example, mattress cores 210 and 220 are described as having springs 214 and 224 disposed therein. However, mattress cores 110, 120, 310, 320 and/or 350 also may have springs disposed therein in alternative embodiments. Thus, it will be appreciated that certain changes and modifications may be practiced within the scope of the appended claims.

What is claimed is:

1. A mattress comprising:

a first mattress core having a bottom surface, a top surface and an outer edge extending between the top surface and the bottom surface;

a second mattress core positioned on top of the first mattress core, wherein the second mattress core has a bottom surface, a top surface and an outer edge extending between the top surface and the bottom surface;

a border material extending along the outer edge of the first mattress core and along the outer edge of the second mattress core, wherein the border material further includes an intermediate portion that extends along the top surface of the first mattress core, is folded back on itself and then extends along the bottom surface of the second mattress core so as to be between the first and second mattress cores and is coupled to at least one of the first and second mattress cores at a location where the intermediate portion extends between the first and second mattress cores; and wherein the border material is a single piece of material spanning at least from the outer edge of the first mattress core to the outer edge of the second mattress core and including the intermediate portion.

2. The mattress as in claim 1 wherein the intermediate portion of the border material extends between and is coupled to both the first and second mattress cores.

3. The mattress as in claim 1, further comprising a length of stitching which couples the intermediate portion of the border to the first or the second mattress core at the location, and wherein the first mattress core comprises a first outer edge, the second mattress core comprises a second outer edge, and the first and second outer edges are biased toward each other at least in part by the connection of the length of stitching.

4. The mattress as in claim 1 wherein the second mattress core comprises a plurality of coils disposed therein.

5. The mattress as in claim 1 wherein the first and second mattress cores each comprise a plurality of coils therein, and wherein the coils in the second mattress core extend about to an edge of the second mattress core.

6. The mattress as in claim 5 wherein an outermost coil of the plurality of coils disposed in the second mattress core is positioned generally over an outermost coil disposed in the first mattress core.

7. The mattress as in claim 1 wherein the outer first edge of the first mattress core is generally flush with the outer second edge of the second mattress core.

8. The mattress as in claim 1 further comprising a padding disposed over the second mattress core.

9. The mattress as in claim 1 wherein the border material wraps around a lower edge of the first mattress core.

10. The mattress as in claim 1 further comprising a third mattress core positioned under the first mattress core.

11. The mattress as in claim 10 wherein the border material extends along an outer third edge of the third mattress core and wherein a second intermediate portion of the border material extends between the first and third mattress cores and is coupled to at least one of the first and third mattress cores.

12. The mattress as in claim 1 wherein the first core comprises a first material selected from a group of materials consisting of latex, foam, fiber, and springs.

13. A mattress comprising:

a first mattress core having a bottom surface, a top surface and an outer edge extending between the top surface and the bottom surface;

a second mattress core positioned on top of the first mattress core, wherein the second mattress core has a bottom surface, a top surface and an outer edge extending between the top surface and the bottom surface;

a border coupling the first mattress core to the second mattress core, wherein the border includes an intermediate portion that extends along the top surface of the first mattress core, is folded back on itself and then extends along the bottom surface of the second mattress core so as to be between the first and second mattress cores and is coupled to at least one of the first and second mattress cores at a location where the intermediate portion extends between the first and second mattress cores; and wherein the first and second mattress cores each comprise a plurality of coils therein, wherein the coils in the second mattress core extend about to an edge of the second mattress core, and wherein the border material is a single piece of material spanning at least from the outer edge of the first mattress core to the outer edge of the second mattress core and including the intermediate portion.

14. The mattress as in claim 13 wherein an outermost coil of the plurality of coils disposed in the second mattress core is positioned generally over an outermost coil disposed in the first mattress core.

15. The mattress as in claim 13 wherein the border comprises a border material extending along an outer first edge of the first mattress core and along an outer second edge of the second mattress core, the border material further defining the intermediate portion of the border therebetween.

16. The mattress as in claim 13 further comprising a third mattress core positioned under the first mattress core, the third mattress core having a third plurality of springs disposed therein.

17. The mattress as in claim 16 wherein the third plurality of springs includes an outermost spring which is generally aligned with outermost springs in the first and second mattress cores.

18. The mattress as in claim 13, further comprising a length of stitching which couples the intermediate portion of the border to the first or the second mattress core at the location, and wherein the first mattress core comprises a first outer edge, the second mattress core comprises a second outer edge, and the first and second outer edges are biased toward each other at least in part by the connection of the length of stitching.

* * * * *